United States Patent [19]

Katz

[11] Patent Number: 4,907,723

[45] Date of Patent: Mar. 13, 1990

[54] FLUID DISPENSER INCLUDING AN ARRANGEMENT TO IMPART WAVE-LIKE MOTION TO THE STORE FLUID

[76] Inventor: Solly Katz, 173 Rechov, Hakeramim, Hakeramin, Efrat, Israel, 90962

[21] Appl. No.: 242,169

[22] Filed: Sep. 8, 1988

Related U.S. Application Data

[63] Continuation-in-part of Ser. No. 24,083, Mar. 10, 1987, Pat. No. 4,784,297.

[30] Foreign Application Priority Data

Mar. 10, 1986 [ZA] South Africa ..... 86/1737

[51] Int. Cl.[4] ..... B67D 5/06

[52] U.S. Cl. ..... 222/105; 222/161; 222/185; 222/196; 206/603; 366/211; 366/274; 366/332; 383/71

[58] Field of Search ..... 222/129, 129.1, 105, 222/161, 164, 160, 196, 185, 143, 144.5; 383/71; 206/603; 366/332, 333, 239, 211, 215, 274, 276, 601; 99/275, 348; 221/130

[56] References Cited

U.S. PATENT DOCUMENTS

| | | | |
|---|---|---|---|
| 515,056 | 2/1894 | Riley | 222/160 X |
| 1,019,093 | 3/1912 | Shanks | 221/130 |
| 3,357,070 | 12/1967 | Sloan | 383/71 X |
| 3,371,824 | 3/1968 | Goss | 222/105 |
| 3,402,854 | 9/1968 | Marchetti | 222/129.1 |
| 3,499,578 | 3/1970 | O'Neal | 222/129.1 X |
| 4,021,023 | 5/1977 | Berg | 366/211 |
| 4,026,531 | 5/1977 | Luchsinger et al. | 366/211 |
| 4,357,740 | 11/1982 | Brown | 383/71 X |
| 4,498,785 | 2/1985 | de Bruyne | 366/274 |
| 4,550,653 | 11/1985 | Hedenberg | 99/348 |
| 4,784,297 | 11/1988 | Katz | 222/185 X |

*Primary Examiner*—Kevin P. Shaver
*Attorney, Agent, or Firm*—Birch, Stewart, Kolasch & Birch

[57] ABSTRACT

A fluid dispenser has a cradle for holding a container of liquid to be agitated before dispensing in a downwardly inclined position towards the dispensing outlet and includes an arrangement for causing a wave-like motion to the contents of the container. The arrangement can include a rocking mechanism for the end of the cradle remote from the dispensing end or an arrangement for intermittently applying pressure to the wall of the container adjacent the dispensing end. The diminishing contents of the container may be compensated for.

18 Claims, 6 Drawing Sheets

FLUID DISPENSER INCLUDING AN ARRANGEMENT TO IMPART WAVE-LIKE MOTION TO THE STORE FLUID

This application is a continuation-in-part of application Ser. No. 07/024,083 filed on Mar. 10, 1987, now U.S. Pat. No. 4,784,297 issued Nov. 15, 1988.

INTRODUCTION

This invention relates to a fluid dispenser and more particularly although not exclusively to a fluid dispenser suitable for dispensing pre-mixed and post-mixed beverages such as fruit juices, soups and the like which have a tendency to stratify if left undisturbed for any significant period of time.

BACKGROUND TO THE INVENTION

Post-mix beverages are generally supplied to the point of sale in concentrated form and are mixed in a container mounted on or connected to a dispenser. Alternatively they may be mixed immediately prior to being placed in a dispenser. Pre-mix beverages are simply poured into the container ready for dispensing. This is known as an open ended system. Any beverage which has a tendency to separate or stratify must be agitated prior to being dispensed. Conventionally open ended systems use, for example, an impeller, a paddle wheel or pump circulation to effect the agitation and prevent sedimentation. Such systems are described in U.S. Pat. Nos. 4,610,145, 3,664,643 and 4,008,832.

One serious problem with the aforementioned systems is that the beverages must be decanted into the mixing container in the dispenser. To ensure that bacteria and the like do not effect the quality of the beverage it is important that the container and agitating means, connecting pipe, pumps and other equipment are cleaned and sterilized regularly. In practice this is often not done and, particularly where a beverage remains in the mixing container for long periods, the quality of the beverage suffers. In fact, by simply decanting the beverage from the sealed and sterilized container in which it is supplied, the beverage comes into contact with the ambient atmosphere and hence any bacteria which might be present therein. To counter this problem, most beverage suppliers add preservatives to their beverages in order to improve the shelf life of the beverages or pasteurise the beverage before packaging. It is also becoming economically and technically viable to irradiate such commodities to preserve them against deterioration.

Many people object to the presence of preservatives in their beverages or object to taste and quality changes resulting from the treatments referred to.

It is accordingly an object of this invention to provide a fluid dispenser with which the aforementioned problems may be overcome or at least minimised.

SUMMARY OF THE INVENTION

According to this invention there is provided a fluid dispenser comprising a cradle for a fluid container in the form of a flexible bag, to hold the container inclined downwardly to a dispensing end thereof and means for intermittently causing a wave-like motion to the contents of the container.

The means for causing the wave-like motion can be means for applying pressure to a wall of the flexible bag.

Further features of this invention provide for the cradle to be supported at the end remote from the dispensing end on springs or for the cradle to include resilient slings to engage around and support the end of the cradle remote from the dispensing end and for the bag to be contained in substantially rigid housing having a removable panel.

The invention also provides for means for applying pressure to the bag to be a plate or other suitably shaped member on the end of a rod connected by means for reciprocating the rod which may be manually powered or motor driven and in which the rod is in the form of telescoped members spring located to the extended position. Other drives may be used and particular reference is made to solenoid and plunger assemblies as well as electromagnetic arrangements to impart intermittent pressure to a wall of the container.

Still further features of this invention provide for the pressure applying means to be located above the container towards the dispensing end or below the container towards the end remote from the dispensing end and for the holder to provide means causing the container to be narrowed within its length and preferably about midway of its length.

The container will preferably be a flexible bag and will be located in the holder with its major dimensions extending over the bottom of the holder.

BRIEF DESCRIPTION OF THE DIAGRAMMATIC DRAWINGS

DETAILED DESCRIPTION OF PREFERRED EMBODIMENTS

Figure 1:
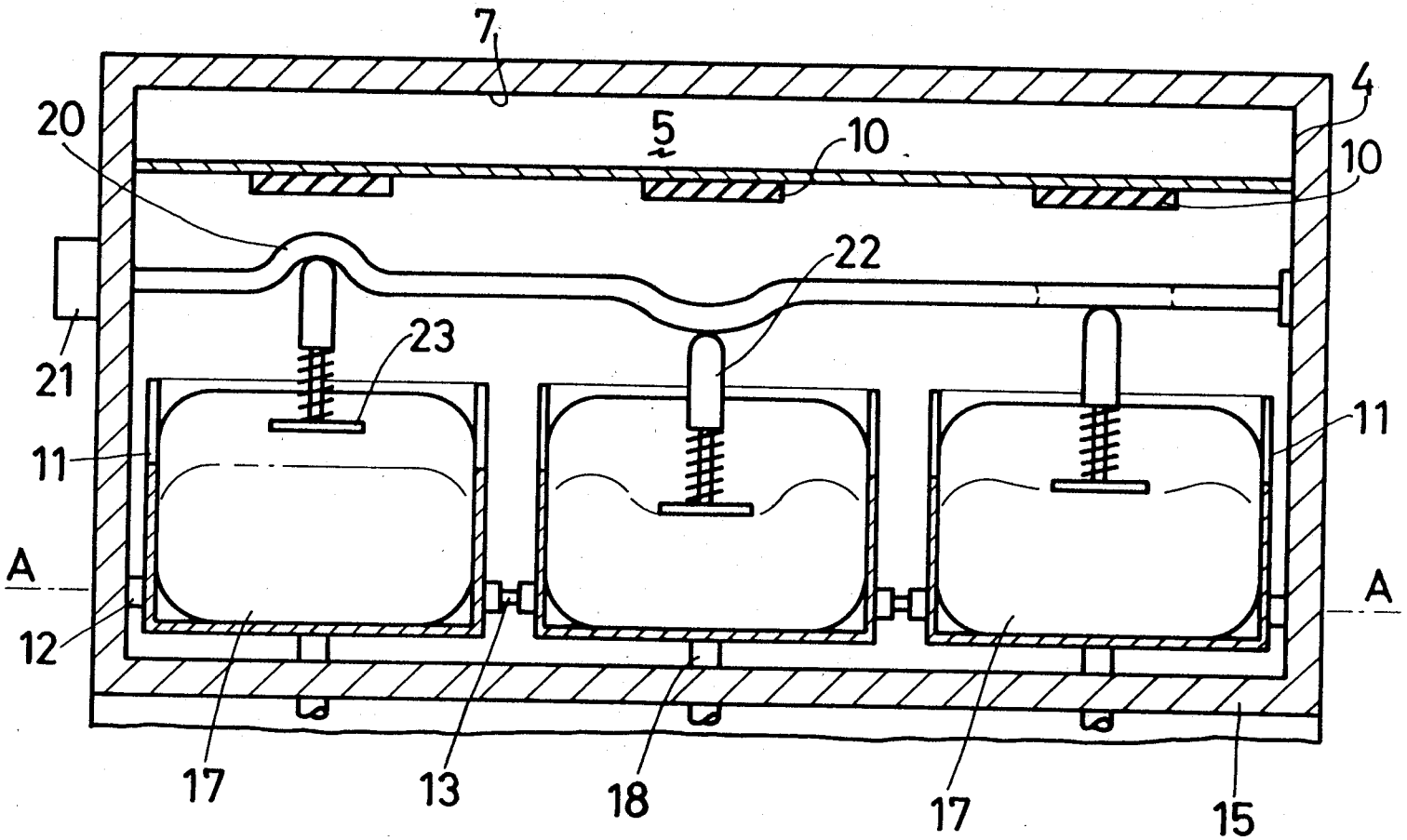
FIG. 1 shows a part-sectional front elevation of one embodiment of the invention in section.

Referring in detail to the drawings there is illustrated a dispenser 1 having adjustable feet 2 standing on a support surface 3. The dispenser is constructed around a support frame 4 and generally comprises an upper cabinet 5 and a lower cabinet 6.

The cabinets have walls 7 formed of a thermally insulating material which serves to insulate the interior of the cabinets from the ambient air. A top hinged door 8 forms a front wall to the cabinet, the door having a seal 9 around its periphery. The door 8 is also formed from an insulating material. Refrigeration coils 10 are shown located within the lower cabinet to ensure that the air temperature within this cabinet can be maintained at a preselected level. It may be preferable to have the refrigeration coils in the upper cabinet in some circumstances. A fan may also be included to assist in maintaining constant temperature in the cabinets.

Figure 3:
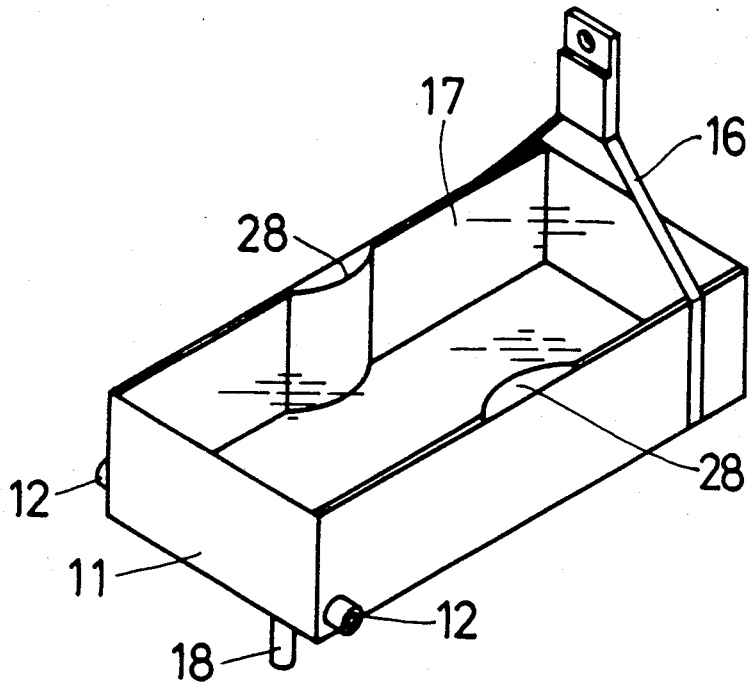
FIG. 3 illustrates a modification including resilient slings.

A plurality of box-like cradles 11 are housed within the lower cabinet. These cradles are preferably pivotally mounted to the support frame through pivotal mounts 12 fitted to the support frame. Stub axles 13 which project laterally out of the lower front of each side of each cradle 11 are engaged with the pivotal mounts 12. Each cradle is thus able to pivot relative to the dispenser frame about an axis of rotation coincident with the axis of the axles 13. The axis of rotation is indicated by letter 'A' in FIG. 1. The rear of the cradles are supported on the upper ends of coil springs 14 mounted on the floor 15 towards the rear of the lower cabinet 6. This ensures that the cradle is tilted downwardly towards the pivoted front end of the cradle. This is of course the outlet end for fluid to be dispensed. Alternative to the coil spring 14, resilient slings 16 FIG. 3 may hold the cradles in the desired tilted configuration. Liquid to be dispensed is situated in containers 17 located in these cradles. In the preferred form of this invention the containers 17 are flexible bags which collapse as liquid is dispensed obviating the need to vent the bag during dispensing. An outlet conduit 18 from each bag passes through an opening in the base of the cradle and through dispensing control valve 19 which will be described more fully herebelow.

Disturbing means is provided for the liquid in the containers and this will take the form of a rotatable cranked arm 20 supported by the frame 4 and being either powered manually through a suitable handle outside of the cabinet 6 or, preferably, through a variable speed motor 21 which can conveniently be mounted outside the cabinet.

Alternatively the motor 21 can be inside the upper cabinet 5 and the cranked arm 20 driven therefrom through gears, belts or other suitable transmission means (not shown).

The cranked arm 20 will be designed to drive push rods 22 each terminating at its free end in a plate 23 adapted to contact a substantial portion of the upper surface of the container 17. The plate 23 will contact the container 17 preferably adjacent the outlet end of the container.

Preferably each push rod will be a telescoping member 24 suitably spring biased to an extended condition. This will enable the push rod to act effectively on both a full and nearly empty container with the movement applied to the push rod by the cranked arm.

Figure 2:
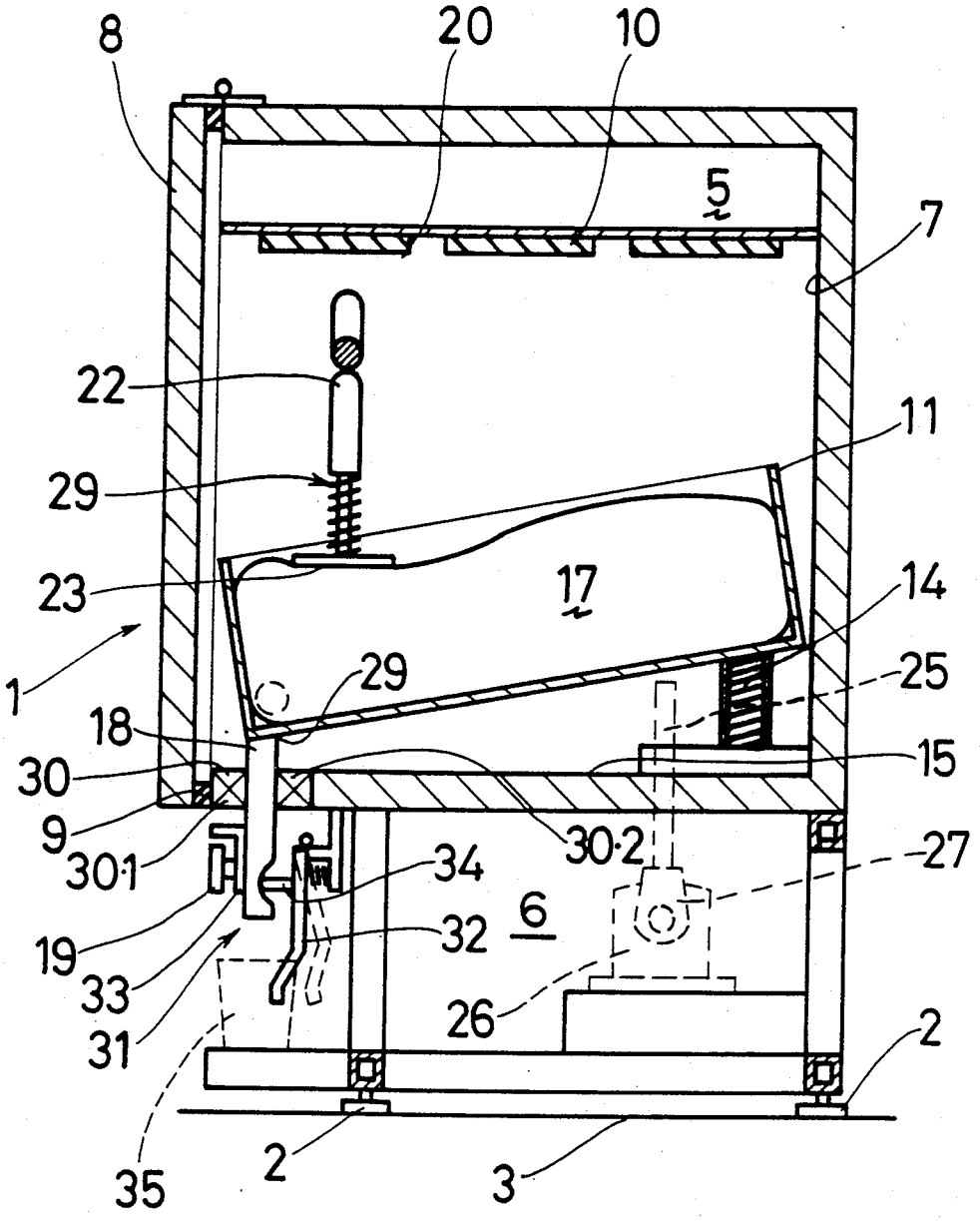
FIG. 2 shows a side elevation of the equipment on a different scale.

Alternatively as indicated in FIG. 2 rocker arms 25 can be made to operate on the rear end of the cradles 11 to lift the rear of the cradles 11 to pivot them about their forward ends. A suitable motor 26 driving a camshaft 27 can be used to move the rocker arm 25 in the required manner.

The compression coil springs 14 will act to increase the degree of tilting of the cradles as the fluid is dispensed from containers held in the cradles.

In any event the rocking of the cradles 11 or application of pressure to be containers through the plates will preferably be done in an out of phase manner indicated in FIG. 1. This enables a minimum of power to be used to agitate the fluid in the containers. It will be appreciated that the tilting of the cradles 11 ensure that less effort is required to rock the cradles than is necessary if the cradles are normally horizontal. Similarly out of phase pressure on the wall of the container adjacent the outlet ensures the use of little effort to provide the required mixing of the contents of the containers.

The main purpose of having the cradles tilted is however to ensure proper evacuation of the containers in a simple manner.

Experience has shown that rocking of the cradles or application of pressure to the containers will cause liquid in the containers to flow back and forth in a wave-like motion causing thorough mixing of the liquid in the containers. Satisfactory mixing can be obtained with cyclic rates as low as 20 to 40 per minute.

This mixing has also been found to be substantially improved by the inclusion in the cradle of obtrusions 28 which cause a waisting of the flexible bag when it is inserted in the container. This is even more pronounced when the flexible bags are located, as is in any event preferable, with their major dimensions parallel to the bottom of the cradle.

As illustrated each cradle has, in the front lower edge thereof, an opening 29 through which passes the supply conduit 18 from the container 17 located within the cradle 11. The conduits 18 are flexible and are able to withstand the continual rocking of the cradle 11 without rupturing. It is considered important that the cradle be dimensioned such that the containers 17 may lie with their longest dimension substantially normal to the pivot axis. It has been found that this provides the best mixing action.

The conduits 18 from each container pass through the openings 29 and down through a specially shaped beam 30 which defines the forward edge of the base 15 to the lower cabinet 6. The beam 30 is formed in two parts, namely a forward part numbered 30.1 and a rearward part numbered 30.2. When the door 8 is open the forward part 30.1 can be detached from the rearward part 30.2. The rearward part 30.2 of the beam 30 has four rounded vertically aligned slots which align with the openings 29 in the cradle. The door 8 seals against the forward face of the forward part of the beam. Thus, when the door is open, and the forward part removed, a conduit can be removed from its rounded slot and the associated container can be removed from the cradle 11 and be replaced with a fresh container.

The lower end of each conduit 18 is shut-off by means of a dispensing device 31 as shown in FIG. 2. Each dispensing device 31 has a pivotally mounted plate 32 spring biased towards an anvil 33. A bar 34 on the plate is positioned to engage the conduit and crimp the conduit between the bar and anvil. This will provide an effective shut-off for the conduit and will ensure that no bacteria or the like is able to ingress into the container through the conduit. Dispensing of liquid takes place by pushing the plate away from the conduit allowing the liquid to dispense under the action of gravity into a cup 35 or other receptacle.

In use, pre-mixed beverages, such as fruit juice or the like will be supplied in a sealed container in the form of a flexible bag. Preferably the bag will have an outlet conduit therefor pre-fitted to it. Alternatively the conduit can be inserted into an appropriate female connector just prior to dispensing. The entire bag will have been sealed and packaged under sterilized conditions and will preferably have been stored and transported in a frozen condition. Natural fruit juice, if properly prepared and frozen, can be kept for periods of up to six months when frozen. The frozen juice will then be allowed to thaw before it is dispensed. For this purpose, the upper cabinet 5 is provided situated above the cradles in which frozen back-up containers may be located prior to dispensing. Generally the temperature inside the upper cabinet will be maintained at 4° C. or to a lower temperature of about 0.5° C. The gradual thawing of the liquid of the back-up containers within the cabinet will enable the temperature within the cabinet to be maintained at 4° C. without the refrigeration apparatus being utilized. This will lead to an energy saving.

When a container is to be replaced, the empty container will be removed from the cradle and a fresh, thawed container placed in position in the cradle. During change over the disturbing means will be switched off. This can be achieved by having a suitable make and break switch so that when the door is opened the agitator will be automatically switched off. The conduit from the fresh container will be passed through the slot in beam 30 and down through the dispensing device 31. Once in position, a seal on the free end of the conduit may be broken and agitation and dispensing may commence. Clearly it will be advantageous if a seal on the conduit is only broken after the container is properly located in position. This will ensure that the beverage as dispensed will not have come into contact with the air at any stage after packaging. Such an arrangement will also minimise the chances of the contents of the container being tampered with prior to the beverage being dispensed.

To prevent re-use of the container after the contents have been dispensed and thus avoid possible contamination from such re-use the bag will preferably be engaged by a suitable clamping or restraining member when it is inserted into the cradle. This clamping member will be such that the flexible bag will be automatically ripped when it is removed empty from the cabinet. In this way it will be ensured that the bag cannot be re-used.

It is envisaged that because it is possible to dispense the beverage without air coming into contact with the liquid prior to dispensing, and because the beverage is maintained at 4° C., the shelf life of the beverage once it has been located in the dispenser will be long. This will mean that fresh fruit juice can be dispensed economically as wastages that occur in present open ended systems will not occur with the dispenser of the present invention.

Experience has shown that the filling and freezing of flexible bags makes handling and transport of the bags, operations which must be undertaken with care. Without such careful treatment folds and tears can occur which can cause serious losses and contamination of the contents of the bag through resultant leakage. This difficulty can be mitigated by using boxes in which the flexible bags are stored or specially designed boxes. The boxes can have a movable or tear off panel 57 shown in an open position in Fig. 4 or a panel of highly flexible material which will be located below the push rod plates in the cradles. The plates will then operate through the openings left by removal of the panel or against the flexible panel. In either case the liquid in the container will be agitated and dispensed as above described but with the box facilitating handling of the container. A small opening will also be provided to accommodate the outlet tube.

With this arrangement the box which constitutes a rigid housing, and container will be slipped in and out of the cradle as required. The boxes may be made such that they can be reused. Thus with little modification existing bag-in-the-box packaging can be adopted for agitated dispensing according to this invention.

It will also be understood that it is not necessary to limit this invention to the agitation of fruit juices within a refrigerated compartment. Clearly other liquids may be dispensed using the basic idea of external agitation. Specifically envisaged are beverages such as soups and the like which would have a tendency to settle into different layers but which would preferably be dispensed hot. Such beverages could be packaged in sealed containers, agitated prior to dispensing, and heated either after or prior to dispensing. By the incorporation of an element into the cabinet which is switched on during dispensing periods to heat the soup and is switched off during periods when no dispensing takes place, a refrigeration cycle can be used to cool the soup during these periods. This will preserve the soup over substantial periods.

It is not essential for the beverages to be dispensed in a closed system from collapsible containers as described herein although this is a preferred form of the invention. Vented containers may be employed. One advantage of the agitation devices disclosed herein is that pumping or circulating equipment which has heretofor been employed for agitation but which must regularly be cleaned and sterilized is no longer necessary. The agitation equipment described herein never comes into contact with the liquid itself and thus the same degree of sterilization is not required.

Where post-mixed beverages are to be dispensed the containers will be charged with concentrate and be of sufficient volume to enable water or other suitable liquid to be added thereto. A suitable filling aperture, which may be incorporated in the outlet conduit, will be provided. The container may have the diluent liquid added immediately prior to insertion of the container into the cabinet or the container can be manufactured so that it can first be inserted into the cabinet and then filled with the diluent liquid.

As described above it has been found that the best mixing takes place when the container in the form of a flexible bag is positioned with its major dimensions over the bottom of the cradle or housing. It is also preferred that the bag be permitted to lie flat in the configuration which it will naturally adopt without lateral constriction. This means that the beverage will have a shallow depth in the dispenser and the wave motion will result in most effective mixing.

Figure 4:
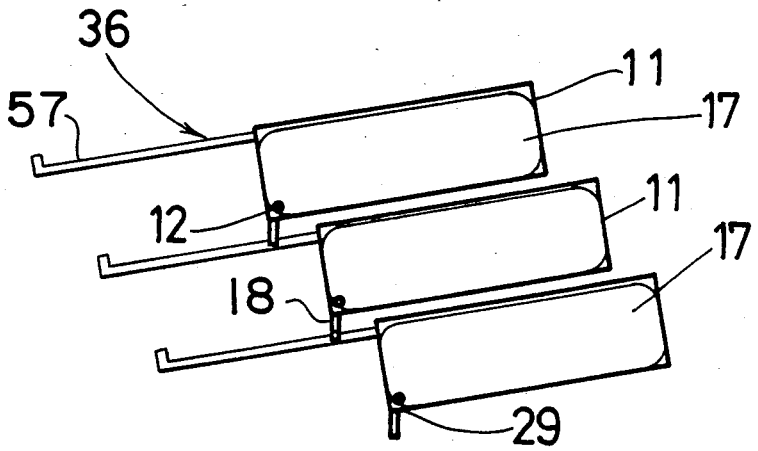
FIG. 4 illustrates a plurality of cradles in a superimposed and stepped relationship.

The flat bag condition above described requires more lateral space than where the bag is located in constricting cradles or housings. In FIG. 4 is illustrated diagrammatically an arrangement where the plurality of cradles 36 are arranged in a superimposed and stepped relationship. This construction will require separate outlet assemblies for each container but this is not considered a disadvantage since the container can if desired be located in separate insulated compartments in the cabinet.

Figure 5:
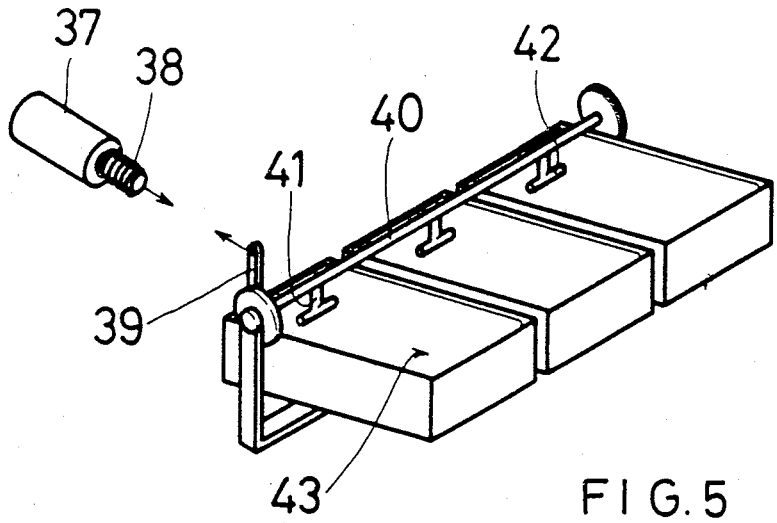
FIG. 5 illustrates an alternative drive motor assembly including a solenoid and plunger assembly.
Figure 6:
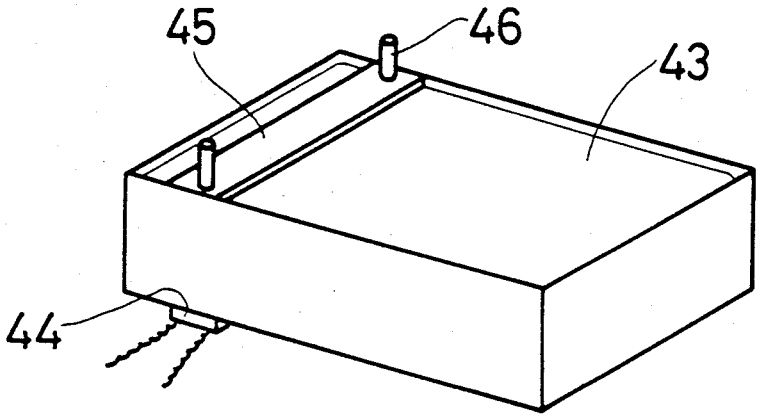
FIG. 6 illustrates an alternative drive motor assembly including an electro-magnet and bar arrangement.

FIGS. 5 and 6 illustrate, also diagrammatically alternative drive motor assemblies in place of the usual electric motor drive described above.

In FIG. 5 the drive motor consists of a solenoid 37 and plunger 38 assembly. The plunger 38 is spring loaded to return to an extended position when the solenoid 37 is not activated. The plunger 38 is connected to a crank 39 from which extends a central rod 40. This rod 40 is supported in suitable bearings (not shown) and carries lever arms 41 terminating in bag engaging plates 42. Thus controlled intermittent actuation of the solenoid 37 will result in the plates 42 being depressed onto the bags 43 to cause the wave motion above described. The lever arms will be offset from each other so the effort will be applied to only one bag 43 at a time. This construction can be made at lower cost than one using a conventional variable speed electric motor. FIG. 6 illustrates yet another simple form of motor drive. In this case an electro-magnet 44 is located across the container to co-operate with a bar 45 of magnetiseable material positioned on the opposite side of the bag to the electro-magnet 44. This bar 45 is carried on suitable guides 46 so that when the electro-magnet 44 is intermittently energised the bar will be drawn towards it and allowed to return along a controlled path and this will result in the wave motion above described being imparted to the contents of the bag. If necessary the bar 45 can be lightly spring loaded against the action of the electro-magnet to ensure proper operation of this drive motor arrangement. However this will not usually be necessary as in all cases with the flexible bag inclined towards the outlet the flow of liquid to reach its equilibrium in the bag will tend to ensure that this outlet end of the bag returns to its normal full condition.

Figure 7:
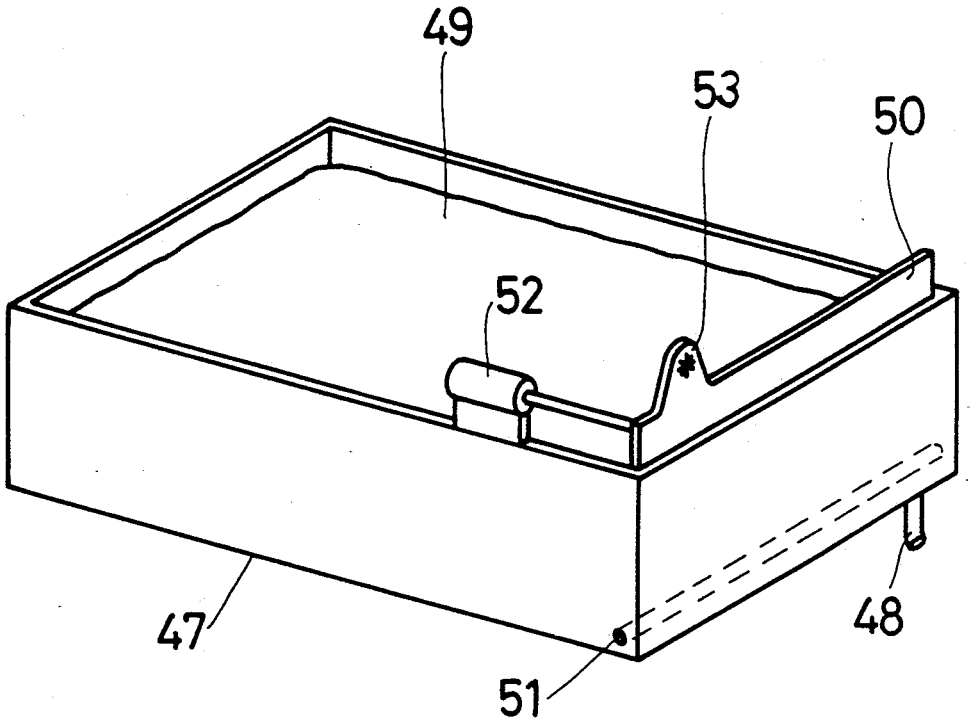
FIGS. 7 and 8 illustrate an alternative arrangement for providing wave like motion including a hinged plate.
Figure 8:
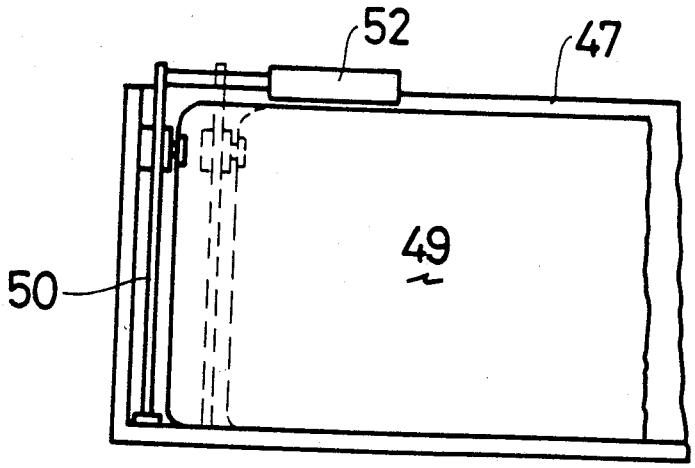
Figure 9:
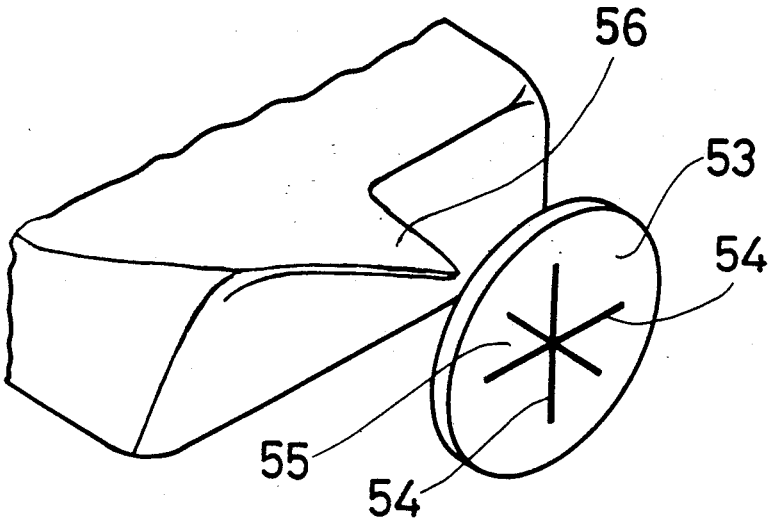
FIG. 9 illustrates a gripping member for tearing a bag upon removal.

Referring to FIGS. 7 to 9 yet a further drive motor assembly is illustrated for imparting a wave-like motion to the contents of the flexible bag. In this assembly the cradle 47 is downwardly inclined towards the outlet 48. The flexible bag 49 is located in the cradle 47 as in the previous embodiments.

Inside the lower end of the cradle 47 is located a plate 50 which extends transversely across the cradle 47 and is hinged at 51 along its lower edge. This plate 50 may thus swing inwardly into the cradle 47 and back towards the end of the cradle. This movement will cause the length of the bag 49 to shorten and lengthen and thus impart the wave-like motion to the contents.

The solenoid and plunger assembly 52 mounted on the side of the container is an inexpensive and efficient means for oscillating the plate 50.

Referring particularly to FIG. 9 there is illustrated a simple means whereby it can be ensure that the bag 49 can be rendered useless after the contents have been dispensed therefrom. A gripping member which in FIGS. 7 and 8 is shown attached to plate 50 but which in other embodiments described can be attached to the holder, is provided. It consists essentially of a disc 53 which has slits 54 equally spaced apart radiating outwardly from the center. This results in flexible sharp pointed elements 55 which can be flexed axially with respect to the disc 53 to provide an aperture therethrough. While reference to a disc 53 has been made it is to be understood that this term is not to be interpreted as limited to a circular plate. Other shapes are obviously also available.

If a corner 56 of the bag 49 is pulled outwardly as indicated in FIG. 9 this part can be forced through the disc 53. Any attempt to withdraw the corner of the bag from the disc will result in the points of elements 55 engaging into the material of the bag which must then be ripped to release the bag 49 from the gripping member. An appropriate choice of material for the disc 53 will ensure that the gripping member described works effectively and over a considerable period of time.

The use of the gripping member ensures that an emptied bag 49 cannot be reused.

The drive assemblies above described can also be used to impart a shaking motion to the cradle and this, with the outlet from the bag held stationary, will also impart a wave-like motion to the contents of the bag.

It is intended that all matter contained in the above description and illustrated in the drawings will be interpreted as illustrative and not in a limiting sense.

I claim:

1. A fluid dispenser comprising a cradle for a fluid container in the form of a flexible bag, said cradle being positioned for holding the container inclined downwardly to a dispensing end thereof, means for intermittently causing wave-like motions to the contents of the container; and the means for causing the wave-like motions comprises means for applying pressure to a wall of the flexible bag adjacent its dispensing end.

2. A fluid dispenser as claimed in claim 1 in which the end of the cradle remote from the dispensing end is supported on compression springs.

3. A fluid dispenser as claimed in claim 1 in which the means for applying pressure comprises a member mounted on a push rod.

4. A fluid dispenser as claimed in claim 1 in which the cradle includes obtrusions causing a narrowing in the length of the flexible bag positioned therein.

5. A fluid dispenser as claimed in claim 1 in which more than one of said container and cradle with outlets at the lower ends of the containers arranged in outward and upward stepped relationship.

6. A fluid dispenser as claimed in claim 1 in which said means for applying pressure comprises a member mounted on a reciprocatable arm connected to be driven by an intermittently operable solenoid and plunger assembly.

7. A fluid dispenser as claimed in claim 1 in which said means for applying pressure comprises an intermittently energisable electro-magnet mounted on one side of the container and a bar of magnetisable material on the opposite side of the container.

8. A fluid dispenser as claimed in claim 1 including a gripping member located in said cradle and being in the form of a disc having a the disc by flexing these elements.

9. A fluid dispenser as claimed in claim 1 in which said means for causing the wave-like motions further comprises means for rocking the cradle about the dispensing end of the flexible container.

10. A fluid dispenser as claimed in claim 9 in which the cradle is supported at its end remote from the dispensing end by a resilient sling.

11. A fluid dispenser as claimed in claim 1 in which said means for applying pressure comprises a plate hinged across the bottom of the outlet end of the cradle with the upper end of the plate connected to means for oscillating this end of the plate.

12. A fluid dispenser as claimed in claim 11 in which the means for oscillating the upper end of the plate is a solenoid and plunger assembly.

13. A fluid dispenser as claimed in claim 1 in which the flexible bag is contained in a rigid housing.

14. A fluid dispenser as claimed in claim 13 in which the housing has a removable panel which is removed to allow said means for applying pressure.

15. A fluid dispenser as claimed in claim 1 in which more than one of said container and cradle are provided and said means rotatably connected to a reciprocatable member for each container, said shaft having means thereon to effect out of phase motion of the members relative to one another.

16. A fluid dispenser as claimed in claim 15 in which each member is located towards the dispensing end of the flexible bag to contact the wall which is operatively the upper wall thereof.

17. A fluid dispenser as claimed in claim 1 in which the container is positioned in the cradle with its major dimensions extending across the bottom of the cradle and extends downwardly along its length.

18. A fluid dispenser as claimed in claim 17 in which the container is located in the cradle and confined solely by walls of the cradle.

* * * * *